US007124883B1

(12) United States Patent
Thomas et al.

(10) Patent No.: US 7,124,883 B1
(45) Date of Patent: Oct. 24, 2006

(54) DUAL-LID CIGARETTE CONTAINER AND METHOD OF PACKAGING CIGARETTES

(76) Inventors: Timothy Frederick Thomas, 3601 Blairwood St., High Point, NC (US) 27265; Barry Smith Fagg, 430 Friar Tuck Rd., Winston-Salem, NC (US) 27104

( * ) Notice: Subject to any disclaimer, the term of this patent is extended or adjusted under 35 U.S.C. 154(b) by 0 days.

(21) Appl. No.: 10/022,016

(22) Filed: Dec. 13, 2001

(51) Int. Cl.
*B65D 85/10* (2006.01)
*B65D 85/20* (2006.01)
*B65D 81/20* (2006.01)

(52) U.S. Cl. ..... 206/256; 206/261; 206/443; 206/524.8; 220/504; 220/555; 220/258.2

(58) Field of Classification Search ..... 206/256, 206/261, 262, 264, 268, 269, 242, 443, 524.8, 206/526, 564; 220/524, 504, 526, 555, 258.1, 220/258.2, 837, 847
See application file for complete search history.

(56) References Cited

U.S. PATENT DOCUMENTS

| | | | | |
|---|---|---|---|---|
| 78,715 | A | 6/1868 | Armour | |
| 197,760 | A | 12/1877 | Brewer | |
| 727,600 | A | 5/1903 | Doscher | |
| 1,104,529 | A | 6/1914 | Mendleson et al. | |
| 1,158,826 | A | 11/1915 | Mendleson | |
| 1,194,905 | A | 8/1916 | Wallenstein | |
| 1,201,474 | A | 10/1916 | Lance | |
| 1,253,219 | A * | 1/1918 | Dula | 206/256 |
| 1,288,150 | A | 12/1918 | Oldenbusch | |
| 1,577,566 | A * | 3/1926 | Cryder | 43/57.2 |
| 1,582,925 | A | 5/1926 | Gross | |
| 2,163,828 | A | 6/1939 | Chalmers | |
| 2,185,604 | A * | 1/1940 | Moore | 206/256 |
| 2,234,649 | A | 3/1941 | Meincke | |
| 2,283,856 | A | 5/1942 | Hoenig | |
| 2,298,945 | A | 10/1942 | Hyatt | |
| 2,591,271 | A | 4/1952 | Levereth | |
| 2,983,424 | A | 5/1961 | Glass | |
| 3,007,623 | A * | 11/1961 | Clemens | 229/120.03 |

(Continued)

OTHER PUBLICATIONS

Office Action mailed Jan. 5, 2005 for U.S. Appl. No. 10/429,000.

(Continued)

*Primary Examiner*—Mickey Yu
*Assistant Examiner*—J. Gregory Pickett
(74) *Attorney, Agent, or Firm*—Kilpatrick Stockton LLP

(57) ABSTRACT

A package or container for holding two or more types or brands of smoking articles, such as cigarettes, having a generally rectangular shape with two openings on opposite sides of the container and a method of making the same is disclosed. The container has two lids, a body, and a separation member that divides the container into two or more compartments, each filled with smoking articles. The lids are made of metal and are hinged to the body on opposite ends of the container using strap hinges made of a paper or foil laminate, and contain printed information such as text and logos. The separation member includes raised portions to hold the smoking articles securely within the compartments and each compartment is sealed with a layer of film that may be pulled up and off of the container compartment using a tab attached to the sealing layer. The freshness and diffusion of aromas from the different types or brands of smoking articles is prevented from migrating between the separate compartments by use of low permeability materials including various plastics and metals.

39 Claims, 4 Drawing Sheets

U.S. PATENT DOCUMENTS

| | | | | | |
|---|---|---|---|---|---|
| 3,039,671 | A | | 6/1962 | Chiamardas | |
| 3,062,385 | A | | 11/1962 | Fletcher | |
| 3,226,010 | A | | 12/1965 | Rogers, Jr. | |
| 4,026,063 | A | * | 5/1977 | Allen et al. | 206/408 |
| 4,081,126 | A | | 3/1978 | Barnard | |
| 4,294,353 | A | | 10/1981 | Focke et al. | |
| 4,778,047 | A | | 10/1988 | Lay | |
| 4,815,592 | A | | 3/1989 | Kunkel | |
| 4,981,229 | A | * | 1/1991 | Lanham | 220/270 |
| 5,042,681 | A | | 8/1991 | Bolte et al. | |
| 5,074,412 | A | | 12/1991 | White | |
| 5,277,304 | A | | 1/1994 | Brizzi et al. | |
| 5,284,291 | A | | 2/1994 | Sellors | |
| 5,353,985 | A | | 10/1994 | Nägeli et al. | |
| 5,467,872 | A | | 11/1995 | Minarelli et al. | |
| 5,513,748 | A | | 5/1996 | Focke et al. | |
| 5,590,763 | A | | 1/1997 | Focke et al. | |
| 5,699,903 | A | | 12/1997 | Focke et al. | |
| 5,934,549 | A | | 8/1999 | Baumgärtner et al. | |
| 5,938,018 | A | * | 8/1999 | Keaveney et al. | 206/261 |
| 6,050,442 | A | | 4/2000 | Wysocki | |
| 6,164,444 | A | * | 12/2000 | Bray et al. | 206/268 |
| 6,223,895 | B1 | | 5/2001 | Bowen et al. | |
| 6,540,084 | B1 | * | 4/2003 | Silvers | 220/524 |
| 6,726,006 | B1 | * | 4/2004 | Funderburk et al. | 206/268 |
| 2003/0029740 | A1 | * | 2/2003 | Caveness | 206/210 |

OTHER PUBLICATIONS

Office Action mailed Feb. 22, 2006 for U.S. Appl. No. 10/429,000.

* cited by examiner

DUAL-LID CIGARETTE CONTAINER AND METHOD OF PACKAGING CIGARETTES

FIELD OF THE INVENTION

The present invention relates to the field of packages and containers for cigarettes and methods for packaging cigarettes. More particularly, the invention relates to special-purpose, multiple-compartment containers made of a durable material that can be separately sealed to preserve the freshness of the cigarette contents of each compartment and specific methods of packaging cigarettes in those containers.

BACKGROUND OF THE INVENTION

Multiple-compartment cigarette packages and containers that accommodate more than one brand or type of cigarette are known in the prior art. Typically, such prior art packages and containers are box-shaped, made of a paper, cardstock or metallic material and contain a hinge associated with each of one or more lids. The compartments are typically sealed as a single package or are individually sealed to preserve freshness and to minimize the transfer of tobacco materials and aromas from one compartment to the next.

U.S. Pat. No. 2,283,856 to Hoenig; U.S. Pat. No. 2,983,424 to Glass; U.S. Pat. No. 3,226,010 to Rogers; and U.S. Pat. No. 5,699,903 to Focke et al. disclose exemplary multi-compartment, individually sealed packages for containing more than one group, brand or type of cigarette. Typically, no more than two individual compartments are included in such prior art packages due primarily to consumer preference. That is, a cigarette consumer may prefer a package for carrying a favorite brand or flavor of cigarette and a secondary brand or flavor of cigarette that is less frequently smoked.

Many different types and arrangements of lids, flaps and hinges associated with multi-compartment packages are disclosed in the prior art. Often, the compartments of the multi-compartment packages are aligned such that the individual openings associated with each compartment are on the same side of the package. Accordingly, the lids or flaps covering the openings, and the hinges associated with the lids or flaps, are on the same side of the package. There may be one lid or flap for each opening or a single lid or flap for both openings. Two separate lids or flaps are illustrated in U.S. Pat. No. 2,983,424 to Glass and U.S. Pat. No. 3,226,010 to Rogers. These patents exemplify two-compartment, dual-lid cigarette packages with the separate lids and hinges on the same side of the package. U.S. Pat. No. 2,163,828 to Chalmers and U.S. Pat. No. 4,081,126 to Barnard disclose two-compartment cigarette packages with a single hinged lid covering both openings on the same side of the package.

In other cigarette package designs, the compartments of the multi-compartment packages are aligned such that their openings are on opposite sides of the package. Accordingly, the lids or flaps covering the openings associated with each compartment on these side-by-side compartments, and the hinges associated with the lids or flaps, are on the opposite side of the package. U.S. Pat. No. 5,074,412 to White and U.S. Pat. No. 5,699,903, for example, illustrate a rectangular, two-compartment cigarette package with hinged lids on opposite sides of the package.

Several prior art cigarette packages are capable of retaining a measure of freshness by sealing the individual compartments in multi-compartment packages or by sealing the entire package, including both compartments. Paper or cardstock materials alone are not well suited to preserving the freshness of the contents of a cigarette container because the web materials used generally do not provide a sufficiently airtight or air-impermeable barrier. Typically, soft pack and hard pack cigarette packages employ inner or outer wraps of metal foil/paper laminates, metallized paper or plastic wrappers, or low permeability transparent polymeric sheet overwraps to protect the freshness and aroma of packaged cigarettes and other smoking article products. However, the use of a plastic container molded from a polymeric material having a relatively high impermeability would eliminate the need to use such wrappers and overwraps or, alternatively, in conjunction with such wrappers and overwraps, the air impermeability of molded plastic containers could be further enhanced. Similarly, the use of a metal container would eliminate the need to use such wrappers and overwraps or, alternatively, in conjunction with such material, the air impermeability of metal containers could be further enhanced.

Similarly, some structures of multi-compartment packages are designed to help preserve the integrity of the contents and offer some protection against crushing. Cardstock materials, for example, are typically used because they have a higher resistance to shear and compression forces than paper packages. However, cardstock packages are vulnerable to damage and crushing under even moderate loads. An example of a hard pack package is shown in U.S. Pat. No. 6,164,444 to Bray et al., which discloses a typical hinged-lid, box-shaped container that is made from a "rigid card material." Further examples of cigarette or tobacco packages made of a paper or cardstock material are disclosed in U.S. Pat. Nos. 1,496,474; 2,960,264; 5,044,550; and 5,097,948.

Still other materials, such as metals, woods and plastic, have also been suggested for use in multi-compartment containers for making crushproof and freshness-preserving cigarette containers. U.S. Pat. No. 2,867,369 to Cernera and U.S. Pat. No. 3,223,275 to Rice, Jr. disclose cigarette containers that may be made of various materials, such as plastic, wood, metal and cardboard.

Prior art cigarette package designs that have included an internal brace member for structural support and for separating the individual package compartments have also included a scalloped or grooved cross-section for holding individual cigarette articles in place. U.S. Pat. No. 5,699,903 to Focke et al. discloses "trough-like recesses" for reducing movement of individual cigarettes and providing structural support. Thermally molded plastic is preferred for structural brace components where the components are shaped to hold individual cigarettes in place because the manufacturing processes for making such plastic components are relatively simple.

Although many features of multiple-compartment cigarette containers are disclosed in the prior art, none of the prior art patents are directed to a rectangularly-shaped, decorative, durable and multi-compartment cigarette package and method of packaging cigarettes like that of the present invention. There remains, therefore, the need for such a package and packaging method to accommodate smokers who prefer to carry two or more different cigarette brands or flavors in a single package.

SUMMARY OF THE INVENTION

It is often the case where cigarette consumers prefer to smoke different flavors or brands of cigarettes. For example, a cigarette consumer may prefer to smoke a certain tobacco blend most of the time but then switch and smoke a flavored cigarette, such as a menthol tobacco blend, on certain occasions. It is generally inconvenient to carry two separate packs of cigarettes to accommodate these consumer preferences, especially when the cigarette consumer smokes the secondary or alternative flavor or brand infrequently. Not only must a separate pack be carried, the freshness of all of the cigarettes in the separate package may be reduced if the package contents are consumed over a long period of time, thereby exposing the unsmoked cigarettes to ambient air conditions for that period of time.

One solution to the problem of carrying two separate packages has been for a consumer to carry one conventional cigarette package and manually insert one or more different flavors or brands of cigarettes in the package. This has the advantage of reducing the number of packages that must be carried, but introduces the problem of mixing tobacco flavors. For example, the aromas given off by tobacco materials due to the volatilization of gases and vapors from the tobacco or additives thereto, such as menthol, vanillin or the like, may transfer to other cigarettes in the package by conventional diffusion and mass transfer mechanisms. Thus, over time, the unique flavors of the individual tobacco blends may be diluted or contaminated by the flavors or additives from other tobaccos in the package.

Thus, there are practical benefits to carrying a single package that contains at least two different cigarettes in separately sealed, substantially impermeable compartments. Accordingly, it is a principal object of the present invention to provide a decorative, durable and multi-compartment package for carrying at least two types or brands of cigarettes in separately sealed, substantially impermeable compartments.

It is another object of the invention to provide a rectangularly-shaped, decorative, durable and multi-compartment package for carrying between three and four different types of cigarettes in separately sealed, substantially impermeable compartments.

Another object of the invention to provide a cigarette package with a separator or divider that bisects the package into multiple compartments, provides structural support for the package and also includes rows of raised portions that hold individual cigarettes in place within the package.

Yet another object of the invention to provide a multi-compartment cigarette package with two lids, one on each side of the package, that are made from aluminum, tin, other metal, or plastic materials, or a combination of these materials, that are characterized by having a low permeability for certain gases and vapors.

Another object of the invention to provide a multi-compartment cigarette package with two lids that are hingedly attached to the package body by straps made from single or laminated or co-extruded layers of metal and/or plastic polymers.

It is another object of the invention to provide a multi-compartment cigarette package with substantially air-impermeable seals between the various compartments containing the different types or brands of cigarettes to minimize the transfer of flavors between the different brands or types of cigarettes in the compartments.

Still another object of the invention to provide a rectangularly-shaped, decorative, durable and multi-compartment cigarette package with peelable, preferably metal foil seals for the compartments.

These and other objects and features of the present invention are accomplished, as embodied and fully described herein according to its apparatus aspects, by a six-sided, rectangularly-shaped container having an internal space for containing smoking articles such as cigarettes, the container including two lids, a body, and a central divider inside the body, and preferably integrally formed with the body, for dividing the container body into multiple compartments and for strengthening the package. The lids are attached to, and on opposite sides of, the body using hinges that allow the lids to be movable between an open position exposing the compartments, and a closed position covering the compartments. The hinges are preferably formed by straps of a flexible, adhesive-backed sheet material adhered to the lids and body of the container.

The central divider has a horizontal part that may be bisected or further divided by one or more vertical parts to further divide the compartments on either or both sides of the horizontal part into two or more additional compartments. The horizontal part of the central divider includes raised portions extending above the top and bottom surfaces of the horizontal part for engaging the cigarettes in the container so as to hold them in place. The lids, the body and the divider are made of at least one material that is characterized as having a low permeability for atmospheric gases and tobacco aromas.

The cigarettes in each of the compartments are preferably different than the cigarettes in any other of the compartments in terms of brand, type, aroma or the like. The container body has an opening for each compartment on opposite sides of the central divider and a perimetrical edge or lip surrounding the opening. A layer of sheet material, such as a plastic or foil laminate, is sealingly attached to the edge of each compartment and covers the opening to preserve the freshness of the cigarettes. The sealing layers preferably have a low permeability and may seal the compartments at a pressure less than atmospheric, i.e., vacuum-packed. Preferably, the sealing layers are adhered to the edges using a conventional hot-melt adhesive.

The raised portions on the horizontal part of the central divider form rows of equally spaced, parallel ridges spanning the full length of the horizontal part. Alternatively, the raised portions form rows of equally spaced, parallel ridges, each ridge having at least two sections that are separated by a gap. Or, the raised portions may be formed by rows of equally spaced bell-shaped protrusions or bumps, each protrusion being spaced from the others protrusions. Or, the raised portions may be formed by semi-circular grooves or troughs in the surface of the horizontal part, each having a curvature approximately equal to the curvature of a conventional cigarette.

The outermost peripheral surface of the wall of the container body is stepped with a pair of peripheral shoulders that accommodate the lids. Thus, when the lids are closed, the edges of the lids abut the shoulders and are flush with the remainder of the wall of the container body to provide a relatively smooth junction between the lids and the body. The lids may also include structures on one or both of the confronting surfaces of the lids or container body to hold the lids in the closed position. Such structures include an interference fit, cooperating detents and other detent structures that will be apparent to those skilled in the art.

The package may be divided into two compartments of approximately equal volume, each compartment being capable of holding up to ten cigarettes. The package may also be divided into three compartments, one of which holds ten cigarettes and the other two compartments being of approximately equal volume each holding five cigarettes. The package may also be divided into four compartments of approximately equal volume, each compartment holding up to five cigarettes. Other arrangements and number of compartments and number of cigarettes in a compartment are also possible and are contemplated within the scope of the present invention.

The low permeability material used to manufacture the package is preferably an injection-moldable polymeric material, such as polypropylene, polyethylene terephthalate or polyethylene vinyl alcohol. The low permeability material may also be metallic. The material used for the lids may be different than the material used for the body and the internal divider or dividers. Further, the body may include an outer layer of metallic material attached to the body that is the same low permeability metallic material as used for the lids. Further still, the low permeability material of the body may be coated with a layer of epoxy to further reduce the permeability of the material.

The two side walls or body panels of the body to which the hinges are attached each include a depression or cutout in the shoulder where it is abutted by the edge of the lid so that when the lids are in their closed positions, a bottom edge of each lid is exposed in the depression. The lids may be opened by engaging the bottom edge of a lid with a finger or fingernail and raising the lid to its open position. The adhesive-backed sheet material hinges connecting the lids to the body may be made of a layer of fibrous web laminated to a layer of metallic foil or polymeric material. Since the cigarette package of the invention is intended to have a relatively short useful life after it is first opened, the hinge material may be made of relatively inexpensive materials.

The objects and features of the present invention may also be accomplished, as embodied and fully described herein, by a method for assembling a package containing smoking articles. The first step of the process includes providing a six-sided, generally rectangularly-shaped container that has two lids, a body and one or more dividers inside the body for dividing the body into several compartments, and including rows of raised portions extending above the top and bottom surface of a central divider for separating the cigarettes contained within the package. The method also includes inserting two different types or brands of cigarettes into the two or more compartments, sealing the cigarettes inside the compartments, and placing the lids over the compartment openings, such that when the lids are closed they are flush with the remainder of the body to provide a smooth transition between the lids and the body. Finally, the method also includes the step of hingedly attaching the lids to the body by adhesively affixing flexible strap hinges to the lids and the body.

The cigarettes may be sealed in their compartments in a vacuum, thereby creating a pressure inside the compartments that is less than atmospheric pressure. In addition, the outer surfaces of the container may be printed with information about the product and the contents of the package or with logos and trademarks to distinguish the cigarette product from the cigarette products of other manufacturers, thereby increasing product identification with consumers. Moreover, the package may be overwrapped with transparent or opaque polymeric overwraps for additional freshness and security of the product.

Other objects, features and advantages of the present invention will become evident to one skilled in the art from the following detailed description of the invention in conjunction with the accompanying drawings.

DETAILED DESCRIPTION OF THE INVENTION

Figure 1:
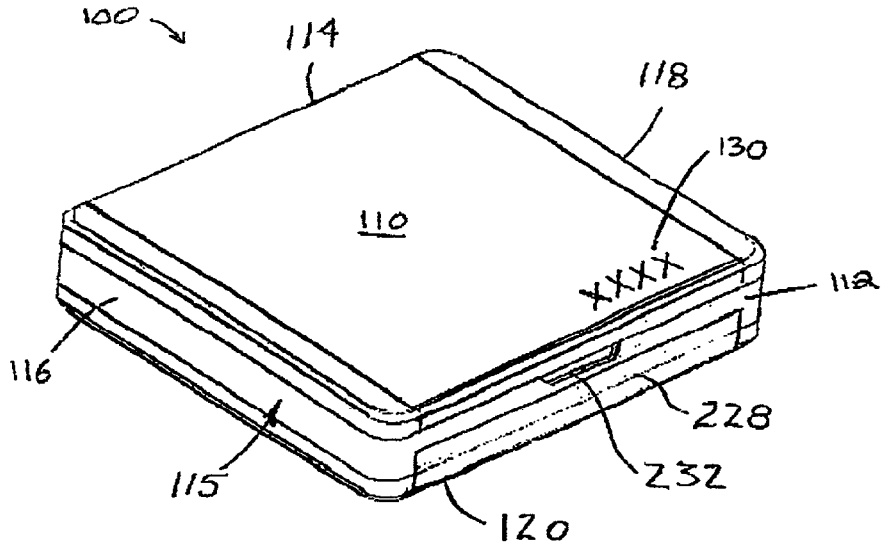
FIG. 1 is a front perspective view of a two-compartment cigarette container made according to the present invention shown in a closed position.

Referring now to the drawings in detail, FIG. 1 is a front perspective view of a two-compartment container 100 made according to the present invention shown in a closed position. Although the container 100 may be used to hold or package a variety of items, the preferred embodiment of the invention is a container for packaging two or more brands or types of cigarettes.

The container 100 is a generally rectangular box having slightly rounded corners with a top 110 and a bottom 120, and front 112, back 114, left and right sides 116, 118. The front, back, left and right sides are preferably manufactured as a single integrally molded container body 115; however, it is also contemplated that the body 115 may be made of individual pieces attached together. The container 100 may contain printed indicia 130 on one or more surfaces of the container, such as text, logos, brand names, etc. The printed indicia 130 may also be conveniently printed on an overwrap made of a foil/paper laminate, a metallized paper or plastic, or a low permeability transparent or metallized polymeric sheet applied to the container 100 to further maintain the freshness of the cigarettes.

Figure 2:
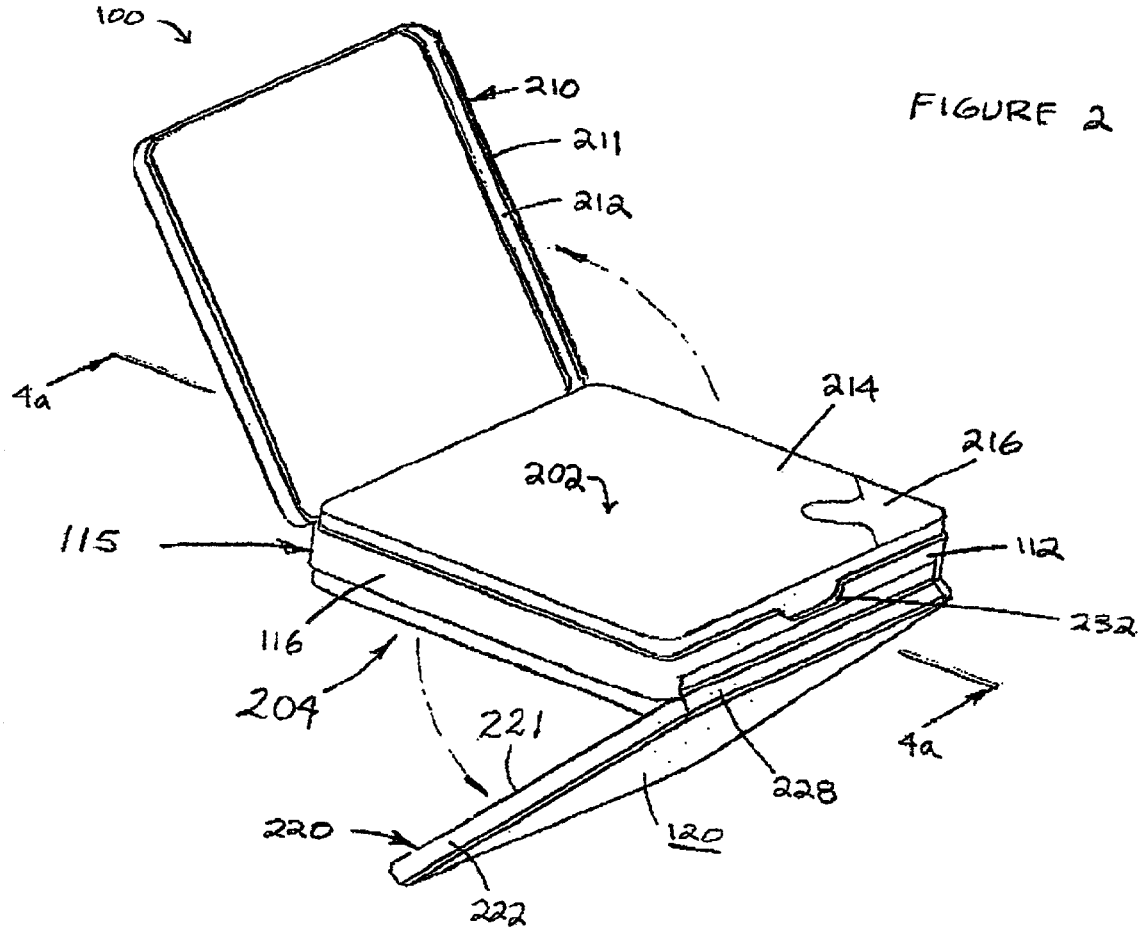
FIG. 2 is a front perspective view of the cigarette container of FIG. 1 with both lids in an open position.

FIG. 2 shows a front perspective view of the cigarette container of FIG. 1 with the lids 210 and 220 shown in an open position revealing openings 202 and 204 (only 202 shown). The container 100 comprises four main components, as shown, including the lids 210, 220, the body 115, and a central divider or separation member 410 (FIG. 4*a*).

The lids 210 and 220 are preferably formed of a lightweight metal, such as aluminum, tin or an inexpensive metal alloy, that protects the contents of the container from being crushed. The metal may be coated, laminated or covered with other materials, such as transparent plastic film or paper labels. Alternatively, the lids 210 and 220 may be made from a heavy cardstock or a laminated or extruded single or multi-layer polymeric materials. The lids 210 and 220 preferably contain printed indicia 130 (FIG. 1).

Figure 4A:
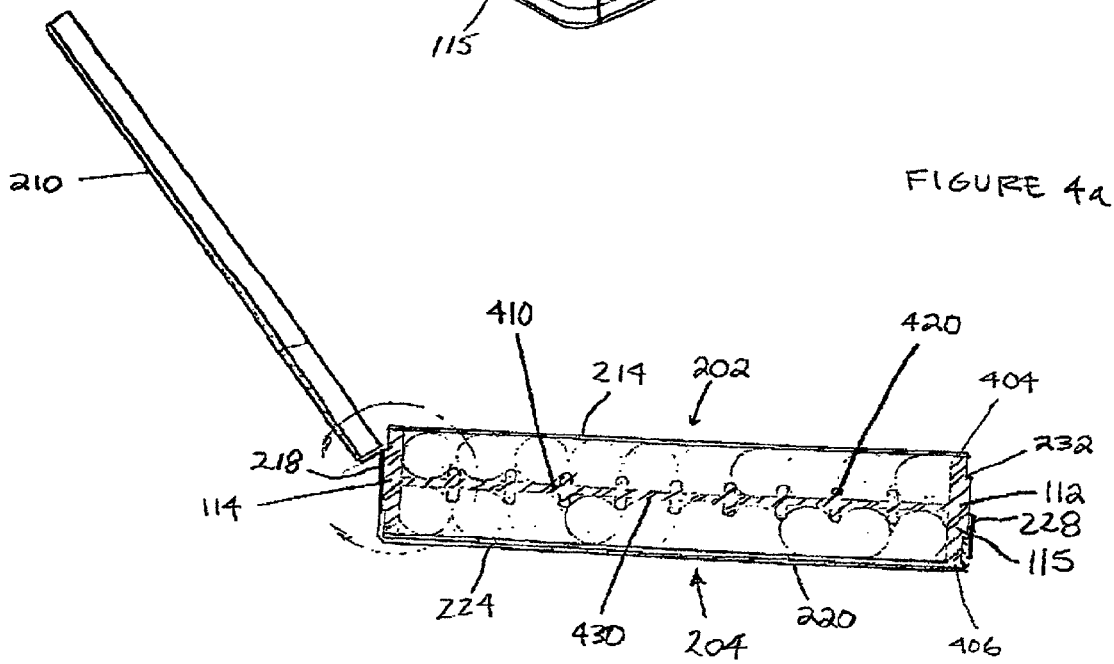
FIG. 4*a* is a cross-sectional view taken along line 4*a*—4*a* of FIG. 2 but with only one of the lids in an open position.

As also shown in FIG. 2, the lids 210 and 220 are provided with flanges 212 and 222 disposed around the entire circumference of the lids 210 and 220, respectively, that extend perpendicular to the lids 210 and 220 as best seen in FIG. 4*a*. The flanges 212 and 222 may have rounded corners corresponding to the shape of the lids. Each flange 212 and 222, may also have slightly rounded or rolled edges 211 and 221, respectively, to help secure the lids in a closed position by friction contact with the container body 115 and to eliminate any sharp edges on the lids. Although the preferred embodiment of the invention includes the flanges 212, 222 and rolled edges 211, 221 as shown in FIG. 2 other lid configurations may be used without departing from the scope of the invention.

The body 115 of the container 100 consists of the front 112, the back 114, the left side 116, and right side 118 body panels and central divider 430 and is preferably molded of a low permeability plastic material that protects the contents of the container from being crushed, supports the lids 210 and 220, and preserves the freshness and aroma of the cigarettes. Although the preferred material is a moldable polymeric material, such as an injection-moldable polypropylene, it is contemplated that the body 230 may be made of other materials, including paperboard, wood, tin, aluminum or other metals without departing from the scope of the invention.

On the front 112 and back 114 panels of the body 115 are two recessed cutouts 232 (only one shown in FIG. 2). The cutouts 232 are positioned essentially mid-point on the front and back panels, and form an area for the consumer to grasp an edge of the flange 212 or 222, and open the lid 210 or 220. The cutouts facilitate opening of the lids 210 and 220 by the consumer by exposing a central portion of the rolled edges 211 and 221 of the flanges 212 and 222 when the lids 210 and 220 are in the closed position (FIG. 1). The consumer may, for example, use a finger or fingernail to engage the exposed edge and lift the lids upwardly from the closed position shown in FIG. 1 to the open position shown in FIG. 2.

Also shown in FIG. 2 is sealing layer 214 with a lifting tab 216 associated with one of the compartments of the container. A similar seal layer 224 (FIG. 4*a*) and lifting tab are associated with the other compartment of the container. The seal layers 214, 224 are semi-opaque thin films made of a polymeric material, including but not limited to polyester, or the films may be made of a metallic foil or metallic foil/paper laminate, or other sheet material, and are adhesively affixed to the edges 404, 406 (FIGS. 4*a* and 4*b*) and of the four panels of the body 115 to close and seal the openings 202, 204 over the cigarette contents C (FIG. 3) and provide a substantially impermeable barrier over the openings to maintain the freshness and aroma of the cigarette contents C.

The lifting tabs 216 are preferably formed integrally as part of the seal layers 214, 224 on one corner thereof as shown in FIG. 2, but may be made of a fibrous or polymeric material adhesively affixed to the top of the seal layers 214, 224. The seal layers 214, 224 are removed from the openings 202, 204 of the container 100 by engaging the lifting tabs 216 and pulling upwardly and diagonally across the openings 202, 204 thereby pulling the sealing layers 214, 224 free from the edges 404, 406 and revealing the contents C of the compartments.

Figure 4B:
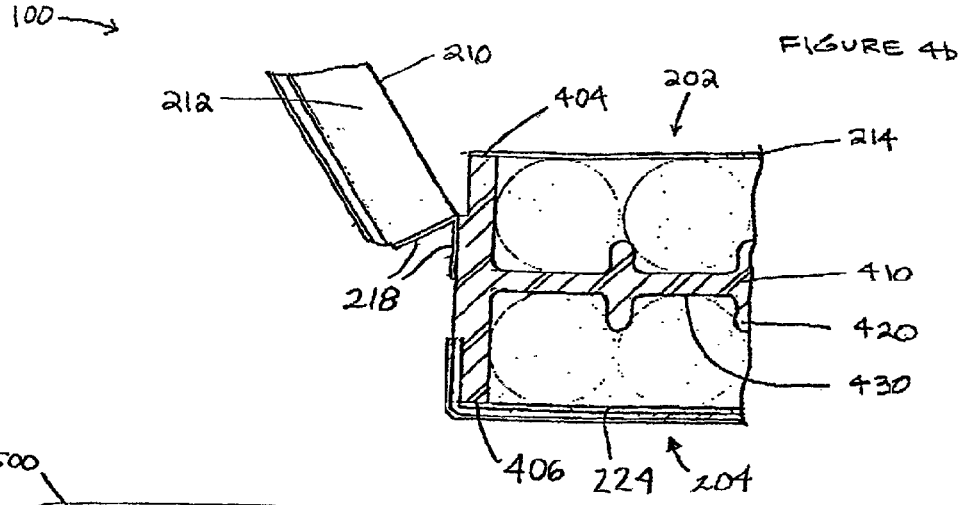
FIG. 4*b* is a fragmentary cross-sectional view taken along line 4*a*—4*a* of FIG. 2 but with only one of the lids in an open position.

Referring still to FIGS. 2 and 4*a*, the lids 210, 220 are pivotably or hingedly attached to the body 115 by a pair of so-called "living" or strap hinges 218, 228, respectively, which are adhered to the body 115 and the lids 210, 220 preferably by an adhesive applied to one surface of the strap hinges. The hinges 218, 228 are narrow flexible flat straps, as best seen in FIGS. 2 and 4*b*, which bend back-and-forth as the lids are pivoted between their open and closed positions. They are preferably made of a fibrous, metal, or polymeric material that resists shearing along the hinge axis. The thickness and specific properties of the strap hinges will be appreciated by those skilled in the art when the life cycle of the container 100 (from one to a few days) and the frequency of use by a consumer (several times up to about 20 times a day) is considered.

Figure 3:
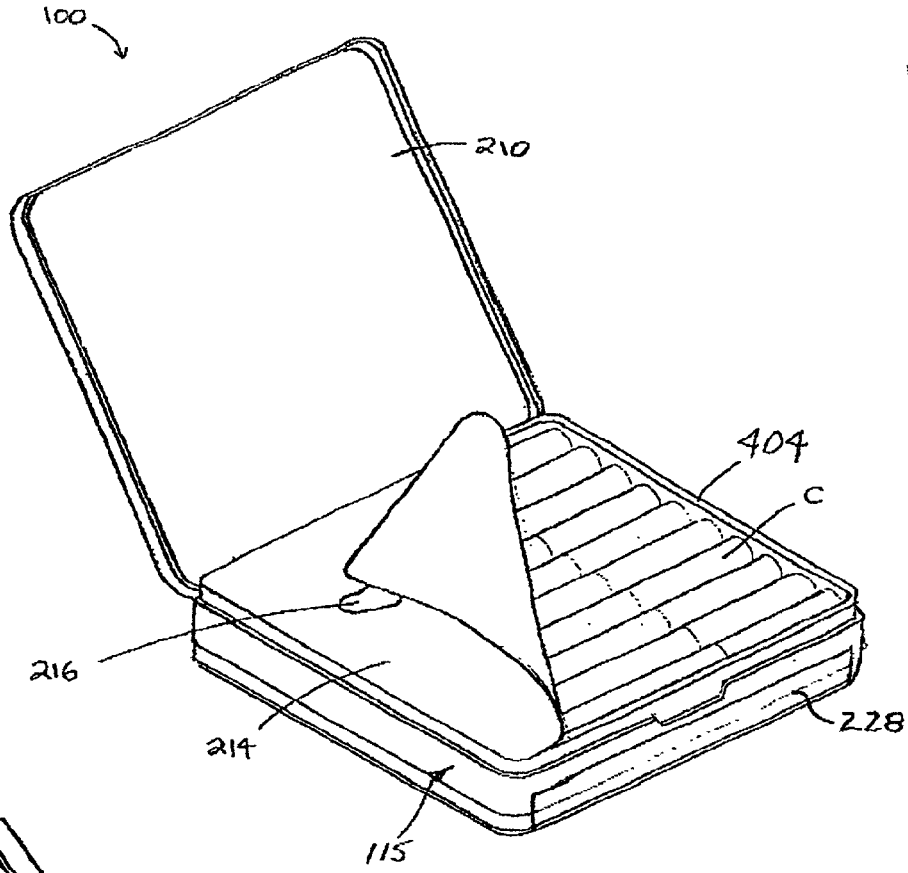
FIG. 3 is another front perspective view of the cigarette container of FIG. 1 with one lid in an open position and showing the contents of one compartment of the container packaged therein.

Referring now to FIG. 3, there is shown another front perspective view of the container 100 of FIG. 1 with the lid 210 in an open position, showing the contents C of the container packaged therein. The container is preferably constructed to hold twenty cigarettes in a 10—10 configuration; that is, two rows often cigarettes, instead of three rows of seven, six, seven (7-6-7) in the most widely used conventional cigarette package.

FIG. 4*a* is a cross-sectional view taken along line 4*a*—4*a* of FIG. 2 with the lid 210 in an open position revealing the opening 202. The container 100 has a central divider or separation member 410 that divides the container into two compartments. The divider 410 also reinforces the container body 115 by connecting the front 112, the back 114, the left side 116 and the right side 118 body panels and further prevents the container 100 from being crushed with consequent damage to the contents C contained therein. The divider 410, which is an integral part of the panels and thus forms an integral part of the body 115, divides the interior of the container into two equally sized compartments, with each compartment holding two rows of up to ten cigarettes (i.e., 10—10). Alternatively, divider 410 may be a separate piece that is affixed to the body 115.

Figure 5A:
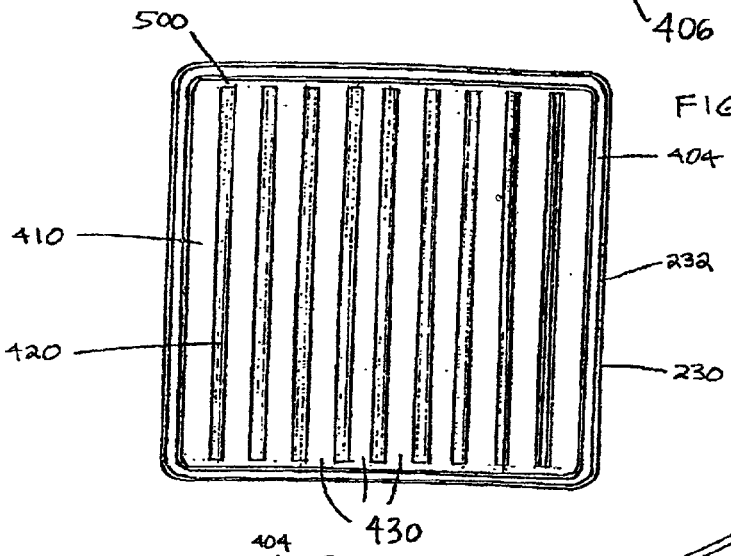
FIG. 5*a* is a top view of a cigarette container made according to the present invention with one of the lids removed to show the internal structure of the container body.

Parallel grooves 430 on opposite sides of the divider 410 are formed by raised ridges 420 that may run the length of the divider 410, preferably parallel to the hinge axes of the lids 210, 220, as best seen in FIG. 5*a*.

Referring now to FIG. 4*b*, a fragmentary cross-sectional view of the container 100 taken along line 4*a*—4*a* of FIG. 2 with the lid 210 in an open position is shown. The lid 210 with the flange 212 and the strap hinge 218 is pivoted to the open position; the seal layers 214, 224 are affixed to the edges 404, 406 thereby covering the openings 202, 204; and the divider 410 is shown with the raised ridges 420 forming the grooves 430.

FIG. 5*a* is a top view of the container 100 made according to the present invention with one of the lids removed to show the internal structure of the container 100. This figure illustrates the construction of the separation member or divider 410 which comprises a flat, preferably plastic, support with a perimeter that corresponds to the inside perimeter of the body 115 below the shoulder 404. The divider 410 is preferably an integral part of the body 115 as shown in FIGS. 4*a* and 4*b*, but it may be a separate extruded plastic piece affixed to the body 115. As shown in FIG. 5*a*, the raised ridges 420 are evenly spaced and run the length of the divider 410 extending almost to the inside wall of the body 115 and providing a gap 500 between the ends of the ridges 420 and the body 115.

Figure 5B:
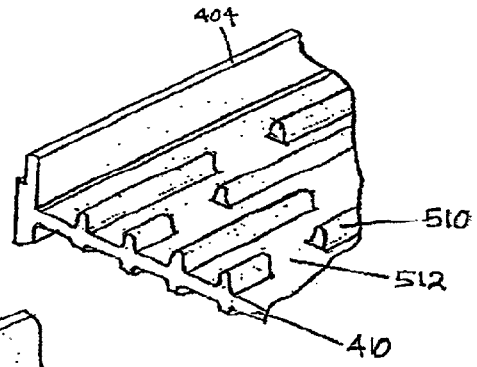
FIG. 5*b* is a perspective view of an alternative of the internal structure of FIG. 5*a;*
Figure 5C:
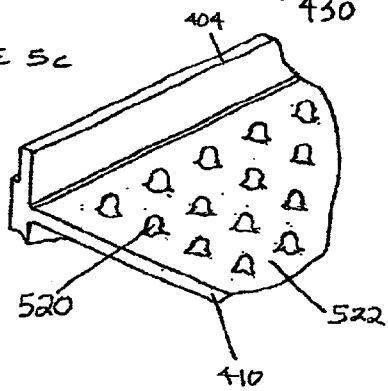
FIG. 5*c* is a perspective view of another alternative of the internal structure of FIG. 5*a;*
Figure 5D:
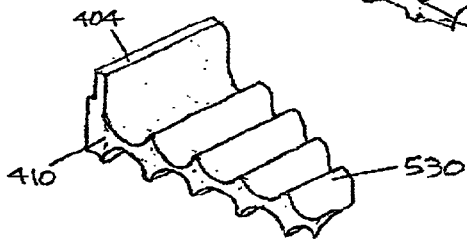
FIG. 5*d* is a perspective view of still another alternative of the internal structure of FIG. 5*a;*

Referring now to FIGS. 5*b*, 5*c* and 5*d*, alternative structural arrangements of the divider 410 with raised protrusions 510 (FIG. 5*b*), 520 (FIG. 5*c*), and 530 (FIG. 5*c*) are shown.

The protrusions 510 are identical in shape to the ridges 420, except that they do not run the entire length of the separation member 410 but are broken up by gaps 512. The protrusions 520 are "bell" shaped protrusions or projections aligned in parallel rows across the surface of the divider 410 separated by gaps 522. The protrusions 530 form semi-cylindrically shaped grooves along the length of the divider 410 with each groove having a curvature similar to the curvature of a conventional cigarette to hold the individual cigarette articles in place. As indicated in FIGS. 5*b*, 5*c* and 5*d*, the protrusions are identically formed on opposite sides of the separation member 410.

The two-compartment container 100 is assembled by first forming the body 115 and the divider 410 as a single piece by a thermoplastic-forming method commonly used in the art, such as injection molding. The plastic material from which the body 115 and divider 410 are molded is preferably an injection moldable polypropylene. Polypropylene is relatively gas impermeable as compared to other moldable polymeric materials; however, other polymeric materials may be used. The material should be substantially impermeable to atmospheric gases, including oxygen, nitrogen as well as moisture vapor, and tobacco aromas.

To improve the impermeability of the body 115 and separation member 410, the molded polypropylene may be treated with a low permeability coating, such as an epoxy amid. Alternatively, the polymeric resin may be a crystallized plastic molding which is a stronger plastic and a better gas barrier then a non-crystallized plastic. Typically, for example, when polyethylene terephthalate (PET) is injection molded, it is left in the amorphous state because it is transparent in that state. However, if the PET is crystallized, it is an opaque white material and its strength and effectiveness as a gas barrier is increased. To crystallize the plastic, the PET is heated to approximately 120 degrees Celsius for about 30 seconds in its desired shape. Alternatively, rather than using PET or other polymeric resin that requires a crystallization step, a more expensive, but inherently highly crystalline resin, such as polyethylene vinyl alcohol (PVA), can be used as the gas impermeable injection molded plastic for the container.

In the packaging process, the cigarette contents C are loaded into the container compartment by way of openings 202, 204 (FIGS. 3 and 4*a*) and arranged in rows such that the ridges 420 separate individual cigarettes. Sealing layers 216, 224 with an adhesive, such as a heat-activated EVA, pressure-sensitive adhesive, on one side thereof are then placed over the openings 202, 204 and adhesively affixed to the edges 404, 406 of the openings using heat and pressure to bond the sealing layers 216, 224 the edges 404, 406. Preferably, the contents C comprise at least two types or brands of cigarettes. If desired or preferred, for example, to keep the different types or brands of cigarettes separate from one another, the compartments of the container 100 may be loaded in separate operations, that is, one compartment may be loaded and sealed on a first production line and the package transferred to another production line where the second compartment is loaded and sealed.

It is also contemplated that the cigarette contents C may be packaged in the compartment without vacuum sealing, however, vacuum sealing advantageously helps to maintain the freshness and shelf life of the cigarettes as well as the perception of freshness. That is, when the vacuum-sealed container of the invention is first opened, an audible "whooshing" sound of air rushing into the container may be produced indicating to the consumer the vacuum packaging of the container and the freshness associated with vacuum packaging.

If, in the alternative, the body 115 is made from a metallic material, it may be die cut from a flat sheet of material as a single piece, then formed about a plastic divider 410 into the shape of the container 100 and the ends welded together. It is also contemplated that the body 115 and divider 410 are made as a single piece using the thermoplastic-forming method noted above, then the outer surfaces of the body 115 may be covered with an adhesive-backed metallic foil layer.

After the cigarettes are loaded and sealed in the container body 115, the lids 210, 220 are then affixed to the body 115 using the strap hinges 218, 228. The strap hinges are adhesively affixed to the lids and body using an adhesive coated on one side of the strap hinges or formed on one side of the strap hinges by a co-extruding process then heat activated when the hinges are applied to the body 115. It is contemplated that the strap hinges 218 and 228 may be printed with decorative and/or informative indicia (including FDA-required labeling information). Also, the lids 210, 220 may be printed with indicia 130 before or after being fabricated or after the container 100 is assembled. Alternatively, as noted previously, a transparent or opaque polymeric film may be printed with indicia and then wrapped about the finished container 100 in a later stage of the manufacturing process.

Figure 6:
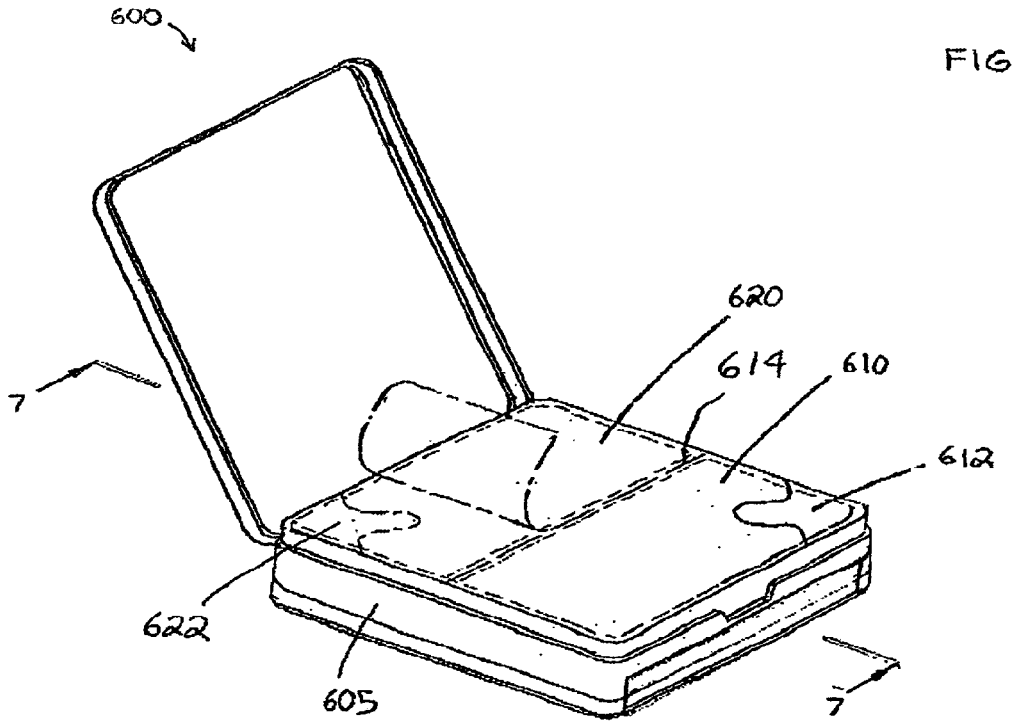
FIG. 6 is a front perspective view of a four-compartment cigarette container made according to the present invention shown with one lid in an open position.

Referring now to FIG. 6, a front perspective view of a four-compartment container 600 made according to the present invention with one lid in an open position is shown. The four-compartment container is preferably constructed to hold twenty cigarettes in a 5-5-5-5 configuration as shown; that is, two rows with two compartments per row containing five cigarettes in each compartment. Other arrangements are also contemplated without deviating from the scope of the invention, including a 10-5-5 configuration, whereby one compartment has ten cigarettes and two compartments each are filled with five cigarettes. A 10-6-4 configuration may also be used. Except as noted below, the structural elements shown in FIG. 6 have been described above in connection with FIGS. 1 through 5*d* and have the same preferred and alternative functions, dimensions and materials of construction as noted previously.

FIG. 6 shows sealing layers 610, 620 with lifting tabs 612, 622 associated with each sealing layer, respectively. Although not shown, the same arrangement of seal layers on the bottom of the container is also contemplated. Sealing layers 610, 620 may be made from a single sheet of material with a line of perforations (holes) or a score line along the centerline 614 that allows one of the sealing layers to be removed while leaving the other affixed to the container 600. This configuration of sealing layers allows each of the four compartments to be individually sealed to preserve the freshness and aroma of the cigarettes in each compartment. It will be appreciated that the seal layers 610, 620 may also be made from separate sheets of material that are affixed to the container 600 by abutting the two pieces together along the centerline 614 as shown and then affixing them to the container 100 with adhesive.

Figure 7:
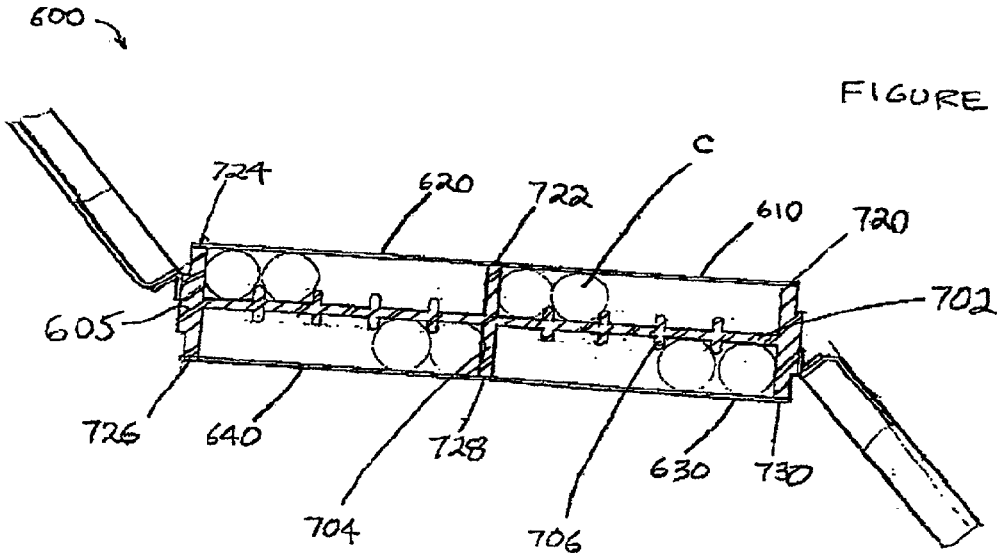
FIG. 7 is a cross-sectional view taken along line 7—7 of FIG. 6 with both lids in an open position.

FIG. 7, which is a cross-sectional view taken along line 7—7 of FIG. 6, shows the configuration of a horizontal separation member or divider 702 and a vertical separation member or divider 704 connected to body 605 forming four compartments in the container 600. As with the previous configurations described above, the protrusions 706, which are an integral part of the horizontal separation member 702, may be constructed in one of several different shapes, including those shown in FIGS. 5*a*, 5*b*, 5*c* and 5*d*, without deviating from the scope of the invention. Also shown in FIG. 7 are edges 720, 722, 724, 726, 728 and 730 with individual sealing layers 610, 620, 630 and 640 affixed thereto.

The method of packaging cigarettes C in container 600 is essentially the same as previously described in connection with manufacturing and packaging the two-compartment container 100.

The above-described containers 100 and 600 provide a combination of advantages for a cigarette package not found in prior art packages. In particular, the cigarette containers of the present invention provide an improved package for containing two or more brands or types of cigarettes in a sealed, low permeability package; an improved reclosable and resealable lid with a novel hinge arrangement and structure; a vacuum-sealed package with an audible "freshness" sound when the compartments are opened; an improved structural strength to prevent crushing of the cigarette contents; and reduced consumer waste upon opening.

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

The invention claimed is:

1. A package for cigarettes comprising a container having an internal space for containing the cigarettes, the container comprising:

a container body comprising a first side body panel, a second side body panel opposite the first side body panel and a separation member disposed between the first and the second side body panels for dividing the internal space of the container body into first and second compartments, the first compartment having a first opening defined by a first edge of the container body, the second compartment having a second opening defined by a second edge of the container body;

a plurality of cigarettes in the first and second compartments;

first and second sealing layers removably affixed to the first and second edges of the container body for sealing the cigarettes in the first and second compartments, wherein the internal space of the container is at a pressure less than atmospheric; and a first lid hingedly attached to the first side body panel and a second lid hingedly attached to the second side body panel such that the first and second lids are attached to the container at substantially diametrically opposed attachment points, and wherein the first and second lids cover the first and second openings of the first and second compartments.

2. The package of claim 1, wherein the first compartment comprises a first brand or type of cigarette and the second compartment comprises a second brand or type of cigarette different from the first brand or type of cigarette.

3. The package of claim 1, wherein the first and second sealing layers are made of a low permeability sheet material and are adhesively affixed to the first and second edges of the container body.

4. The package of claim 3, wherein the first and second sealing layers comprise one of a metal foil, a polymeric laminate, a coextruded polymeric film, a metal foil/polymeric film laminate, a paper/metal foil laminate and a paper/polymeric film laminate.

5. The package of claim 1, wherein the body comprises further separation members for dividing the internal space of the container body into at least three compartments.

6. The package of claim 1, wherein the container is rectangularly shaped, the body panels of the container body further comprising front and back body panels.

7. The package of claim 6, wherein the body panels and the separation member are integrally molded in one piece of a polymeric material.

8. The package of claim 1, wherein the separation member comprises a planar member formed integrally with the body panels, the planar member having opposite surfaces each forming a bottom surface of a respective compartment and including a plurality of parallel protrusions formed on the bottom surface of each compartment.

9. The package of claim 8, wherein the plurality of protrusions comprise one of continuous ridges, interrupted ridges, bell-shaped projections and semi-circular troughs.

10. The package of claim 1, wherein the first and second lids are attached to the container body by first and second hinges connected between the lids and the container body.

11. The package of claim 10, wherein the first and second hinges comprise straps of a flexible sheet material adhesively affixed to the container body and a respective first and second lid, the flexible sheet material comprising an adhesive-backed metal or polymeric foil.

12. The package of claim 1, wherein the first and second lids are attached to the container body by first and second hinges connected between the lids and the container body, the first and second hinges being disposed on opposite sides of the container body and having parallel hinge axes.

13. The package of claim 1, wherein the first and second lids each have peripheral flanges with edges and the container body has first and second peripheral shoulders on an outer surface thereof such that when the first and second lids are in the closed position, the edges of a respective flange abut a respective first and second peripheral shoulder so as to provide a smooth junction between the lids and the container body.

14. The package of claim 12, wherein the first and second lids are made of a metal material.

15. The package of claim 7, wherein the polymeric material is an injection-moldable polymeric material selected from the group consisting of polypropylene, polyethylene terephthalate and polyethylene vinyl alcohol.

16. The package of claim 13, including a cutout in each of the first and second peripheral shoulders for exposing the edge of a respective lid flange and facilitating opening of a respective first and second lid.

17. The package of claim 8, including divider members affixed perpendicularly to the opposite surfaces of the planar member of the separation member for dividing each of the first and second compartments into third and fourth compartments, each divider member having an edge substantially coplanar with the first and second edges, respectively, of the first and second openings, the first and second sealing layers being removably affixed to a respective edge of a divider member.

18. The package of claim 17, wherein the first and second sealing layers are perforated or scored along a line corresponding to a respective edge of a divider member.

19. The package of claim 1, wherein each sealing layer includes a tab attached thereto for gripping and peeling the sealing layers from the respective first and second edges of the container body.

20. The package of claim 19, wherein the tabs are integrally formed in one piece with its respective sealing layer.

21. A container for packaging two or more brands or types of cigarettes comprising:

a generally rectangularly shaped container body having an internal space for containing the cigarettes, the container body comprising a front body panel, a back body panel, a first side body panel, and a second side body panel and a separation member connected to the body panels and dividing the container body into first and second compartments, each compartment having a perimetrical edge defining first and second openings on opposite sides of the container body;

a plurality of cigarettes of a first brand or type disposed in the first compartment;

a plurality of cigarettes of a second brand or type, different from the first brand or type, disposed in the second compartment;

first and second sealing layers adhesively affixed to a respective perimetrical edge of the first and second compartments to seal the cigarettes in their respective compartments, and wherein the internal space of the container is at a pressure less than atmospheric;

a first lid hingedly attached to the first side body panel of the container body for covering and accessing the first compartment; and a second lid hingedly attached to the second side body panel of the container body such that the first and second lids are hingedly attached to the container at substantially diametrically opposed attachment points for covering and accessing the second compartment.

22. The package of claim 21, wherein the first and second lids, the container body and the separation member are made of materials that have a low permeability.

23. The package of claim 21, wherein the first and second lids are hingedly attached to the container body by straps of a flexible sheet material adhesively affixed between the container body and a respective lid.

24. The package of claim 21, wherein the container body and the separation member are integrally molded in one piece of a polymeric material.

25. The package of claim 24, wherein the polymeric material is an injection-moldable polymeric material selected from the group consisting of polypropylene, polyethylene terephthalate and polyethylene vinyl alcohol.

26. The package of claim 21, wherein the separation member comprises a planar member formed integrally with the body panels, the planar member having opposite surfaces each forming a bottom surface of a respective compartment and including a plurality of parallel protrusions formed on the bottom surface of each compartment.

27. The package of claim 26, wherein the plurality of protrusions comprise one of continuous ridges, interrupted ridges, bell-shaped projections and semi-circular troughs.

28. The package of claim 21, wherein the first and second lids each have peripheral flanges with edges and the container body has first and second peripheral shoulders on an outer surface thereof such that when the first and second lids are in the closed position, the edges of a respective flange abut a respective first and second peripheral shoulder so as to provide a smooth junction between the lids and the container body.

29. The package of claim 21, wherein the separation member comprises a horizontal part and a vertical part that bisects at least one of the first and second compartments to form a third compartment for containing cigarettes of different types or brands.

30. The package of claim 21, wherein the separation member comprises a horizontal part and two vertical parts, each of which bisects a respective one of the first and second compartments to form four compartments for containing cigarettes of different types or brands.

31. The package of claim 21, wherein the lids are formed of an aluminum material.

32. The package of claim 28, wherein the lids are formed of metal with depending flanges having rolled edges that abut the peripheral shoulders.

33. A method of making a cigarette package comprising the steps of:

providing a container body with an internal space comprising first and second side body panels and a separation member disposed between the body panels for dividing the internal space of the container body into first and second compartments, the first compartment having a first opening defined by a first edge of the container body, the second compartment having a second opening defined by a second edge of the container body;

inserting a first plurality of cigarettes into the first compartment;

affixing a sealing layer over the first compartment to seal the first plurality of cigarettes therein, wherein the first and second compartments are at a pressure less than atmospheric;

inserting a second plurality of cigarettes into the second compartment;

affixing a sealing layer over the second compartment to seal the second plurality of cigarettes therein;

placing first and second lids over the first and second compartments; attaching a hinge between the first lid and the first side panel of the container body; and attaching a hinge between the second lid and the second side panel of the container body such that the first and second lids are attached to the container at diametrically opposed attachment points.

34. The method of claim 33, wherein the inserting steps are performed substantially simultaneously with one another and the affixing steps are performed substantially simultaneously with one another.

35. The method of claim 33, wherein the first plurality of cigarettes comprises cigarettes of a first brand or type and the second plurality of cigarettes comprises cigarettes of a second brand or type different than the first brand or type.

36. A package for articles comprising a container having an internal space for containing the articles, the container comprising:

a container body comprising a first side body panel, a second side body panel opposite the first side body panel and a separation member disposed between the first and the second side body panels for dividing the internal space of the container body into first and second compartments, the first compartment having a first opening defined by a first edge of the container body, the second compartment having a second opening defined by a second edge of the container body;

first and second sealing layers removably affixed to the first and second edges of the container body for sealing the articles in the first and second compartments, wherein the internal space of the container is at a pressure less than atmospheric; and a first lid hingedly attached to the first side body panel and a second lid hingedly attached to the second side body panel such that the first and second lids are attached to the container at substantially diametrically opposed attachment points, and wherein the first and second lids cover the first and second openings of the first and second compartments, wherein the separation member comprises a planar member formed integrally with the body panels, the planar member having opposite surfaces each forming a bottom surface of a respective compartment and including a plurality of parallel protrusions formed on the bottom surface of each compartment.

37. The package of claim 36, wherein the plurality of protrusions comprise one of continuous ridges, interrupted ridges, bell-shaped projections and semi-circular troughs.

38. The package of claim 36, including divider members affixed perpendicularly to the opposite surfaces of the planar member of the separation member for dividing each of the first and second compartments into third and fourth compartments, each divider member having an edge substantially coplanar with the first and second edges, respectively, of the first and second openings, the first and second sealing layers being removably affixed to a respective edge of a divider member.

39. The package of claim 38, wherein the first and second sealing layers are perforated or scored along a line corresponding to a respective edge of a divider member.

* * * * *